US007520253B2

(12) United States Patent
Mochizuka et al.

(10) Patent No.: US 7,520,253 B2
(45) Date of Patent: Apr. 21, 2009

(54) TWO-STROKE INTERNAL COMBUSTION ENGINE

(75) Inventors: Mitsujiro Mochizuka, Tokyo (JP); Kentaro Matsuo, Saitama (JP); Takahiro Yamazaki, Tokyo (JP); Shigeru Sato, Saitama (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 11/924,665

(22) Filed: Oct. 26, 2007

(65) Prior Publication Data

US 2008/0098992 A1 May 1, 2008

(30) Foreign Application Priority Data

Oct. 27, 2006 (JP) ..... 2006-293221

(51) Int. Cl.
*F02B 25/00* (2006.01)

(52) U.S. Cl. ..... 123/73 PP; 123/65 A; 123/65 V

(58) Field of Classification Search ..... 123/65 A, 123/65 V, 65 P, 73 R, 73 A, 73 PP
See application file for complete search history.

(56) References Cited

U.S. PATENT DOCUMENTS 6,450,135 B1 9/2002 Araki
6,571,756 B1 6/2003 Rosskamp et al.
6,662,766 B2 12/2003 Araki et al.

FOREIGN PATENT DOCUMENTS

JP H05-033657 9/1993
JP 2001329844 A * 11/2001

* cited by examiner

*Primary Examiner*—Noah Kamen
(74) *Attorney, Agent, or Firm*—Kilyk & Bowersox, P.L.L.C.

(57) ABSTRACT

A cylinder bore (4) of a two-stroke internal combustion engine (1) has first scavenging ports (12) and second scavenging ports (13) inside. The first scavenging ports (12) are nearer to an exhaust port (11) of the engine (1) than the second scavenging ports (13). In each scavenging stroke, the second scavenging ports (13) are opened earlier than the first scavenging ports (12) and introduce fuel-free air (A) from the second scavenging ports (13) into a combustion chamber (6). The first scavenging ports (12) are opened later and introduce an air-fuel mixture (M) pre-compressed in a crank chamber (8) into the same combustion chamber (6). Thus, harmful substances contained in exhaust gas discharged from the engine (1) are reduced.

7 Claims, 11 Drawing Sheets

TWO-STROKE INTERNAL COMBUSTION ENGINE

The present application claims priority from Japanese Patent Application No. 2006-293221, filed Oct. 27, 2006, which is incorporated herein by reference.

FIELD OF THE INVENTION

The present invention generally relates to two-stroke internal combustion engines. More particularly, the present invention relates to such engines used as a power source of portable power working machines such as chain saws, hedge trimmers, brush cutters, and the like.

BACKGROUND OF THE INVENTION

Two-stroke gasoline engines have been used as a power source of portable power working machines such as hedge trimmers, brush cutters, chain saws or the like. In a two-stroke engine of this type, a combustion chamber is scavenged by a flow of air-fuel mixture pre-compressed in a crank chamber. More specifically, as the piston ascends, the air-fuel mixture is introduced into the crank chamber, and pre-compressed by the descending piston. Then, during the scavenging stroke, the pre-compressed air-fuel mixture is introduced into the combustion chamber to force waste combustion gas (exhaust gas) out of the combustion chamber and replace it.

As such, the two-stroke engines are configured to scavenge the combustion chamber by using flows of air-fuel mixture, and therefore involve the problem of "blow-by". That is, a part of the air-fuel mixture, introduced into the combustion chamber but having not burnt, is discharged away from the combustion chamber together with the combustion gas. This "blow-by" phenomenon makes it difficult to take effective measures for emissions cut of two-stroke engines.

To control the "air-fuel mixture blow-by" phenomenon, the "stratified scavenging" technique has been proposed in Document 1 (U.S. Pat. No. 6,571,756), Document 2 (Japanese Laid-open Publication No. H05-33657) and Document 3 (Japanese Laid-open Publication No. 2000-240457). Document 1 proposes to introduce fuel-free air (air not containing a fuel) from a first pair of scavenging ports nearer to an exhaust port and an air-fuel mixture from a second pair of scavenging ports remoter from the exhaust port into a combustion chamber during a scavenging stroke, thereby forming a layer of fuel-free air between the air-fuel mixture and the combustion gas in the combustion chamber.

More particularly, Document 1 proposes to provide the first and second scavenging ports in each of left and right cylinder walls at opposite sides of the exhaust port. The first pair of scavenging ports nearer to the exhaust port and the second pair of scavenging ports remoter from the exhaust port are opened simultaneously, and introduce fuel-free air from the first pair of scavenging ports into the combustion chamber and the air-fuel mixture from the second pair of scavenging ports into the same combustion chamber.

Similarly, Document 2 proposes to provide the first and second scavenging ports in each of left and right cylinder walls at opposite sides of the exhaust port. Thus, the engine first introduces fuel-free air from the first pair of scavenging ports nearer to the exhaust port into the combustion chamber, and next introduces an air-fuel mixture from the second scavenging ports remoter from the exhaust port into the same combustion chamber.

Document 3 proposes to provide a first scavenging port in each of left and right cylinder walls at opposite sides of an exhaust port and a second scavenging port in a location opposed to the exhaust port. In a scavenging stroke, this engine first introduces fuel-free air from the pair of first scavenging ports into a combustion chamber, and next introduces an air-fuel mixture from the pair of second scavenging port opposed to the exhaust port into the same combustion chamber.

Document 4 (Japanese Laid-open Publication No. 2002-129963) also proposes a technique for minimizing the "blow-by of air-fuel mixture" phenomenon. This document proposes to provide first and second scavenging ports in each of left and right cylinder walls at opposite sides of the exhaust port. In a scavenging stroke, fuel-free air is first introduced from the first and second scavenging ports into a combustion chamber, and an air-fuel mixture is next introduced from the first and second scavenging ports into the same combustion chamber.

In the recent society involving discussions on environmental problems, it is an urgent request to further reduce harmful emissions from combustion gases.

It has been acknowledged that there is some limit to the conventional stratified scavenging technique that introduces fuel-free air into the combustion chamber from the first pair of scavenging ports located nearer to the exhaust port while introducing an air-fuel mixture into the same combustion chamber from the second pair of scavenging ports located remoter from the exhaust port as disclosed in the above-discussed Document 2 and others. Under the situation, further improvement is required.

SUMMARY OF THE INVENTION

It is therefore desirable to overcome the above-mentioned drawbacks of the related art by providing a two-stroke internal combustion engine that emits exhaust gas containing less harmful emissions.

It is also desirable to provide a two-stroke internal combustion engine using a stratified scavenging system based on a concept different from the conventional one.

According to an embodiment of the present invention, there is provided a two-stroke internal combustion engine configured to introduce fuel-free air into a combustion chamber together with a air-fuel mixture pre-compressed in a crank chamber in a scavenging stroke, comprising:

a cylinder bore in which a piston is fitted to reciprocally move and define the combustion chamber therein;

an exhaust port formed in the cylinder bore to be opened and closed by the piston;

first scavenging ports formed in the cylinder bore to be opened and closed by the piston; and second scavenging ports formed in the cylinder bore to be opened and closed by the piston, the second scavenging ports being remoter from the exhaust port than the first scavenging ports, wherein, in the scavenging stroke, the second scavenging ports are opened earlier than the first scavenging ports to introduce fuel-free air therefrom into the combustion chamber, and the first scavenging ports are opened later to next introduce an air-fuel mixture pre-compressed in the crank chamber into the combustion chamber.

In the above two-stroke internal combustion engine (1), the second scavenging port (13) located remoter from the exhaust port (11) are opened earlier to introduce the air (A) into the combustion chamber (6), and the first scavenging ports (12) located nearer to the exhaust port (11) are opened later to introduce the air-fuel mixture (M) into the combustion chamber (6) in each scavenging stroke. Thus, the air (A) introduced earlier into the combustion chamber (6) results in enveloping the air-fuel mixture (M) introduced later into the combustion chamber (6) through the first scavenging ports (12) that are opened later than the second scavenging ports (13). Therefore, it is possible to prevent that the air-fuel mixture (M) introduced into the combustion chamber (6) and having not burned is discharged to the exhaust port (11). In other words, the so-called "blow-by" phenomenon is prevented. Prevention of the blow-by of air-fuel mixture, which is the problem in the two-stroke internal combustion engines, makes it possible to reduce the content of harmful emissions in exhaust gas (E).

These and other features, aspects and advantages of the present invention will become apparent from detailed description of embodiments of the present invention in conjunction with the accompanying drawings.

DETAILED DESCRIPTION OF THE INVENTION

Figure 1:
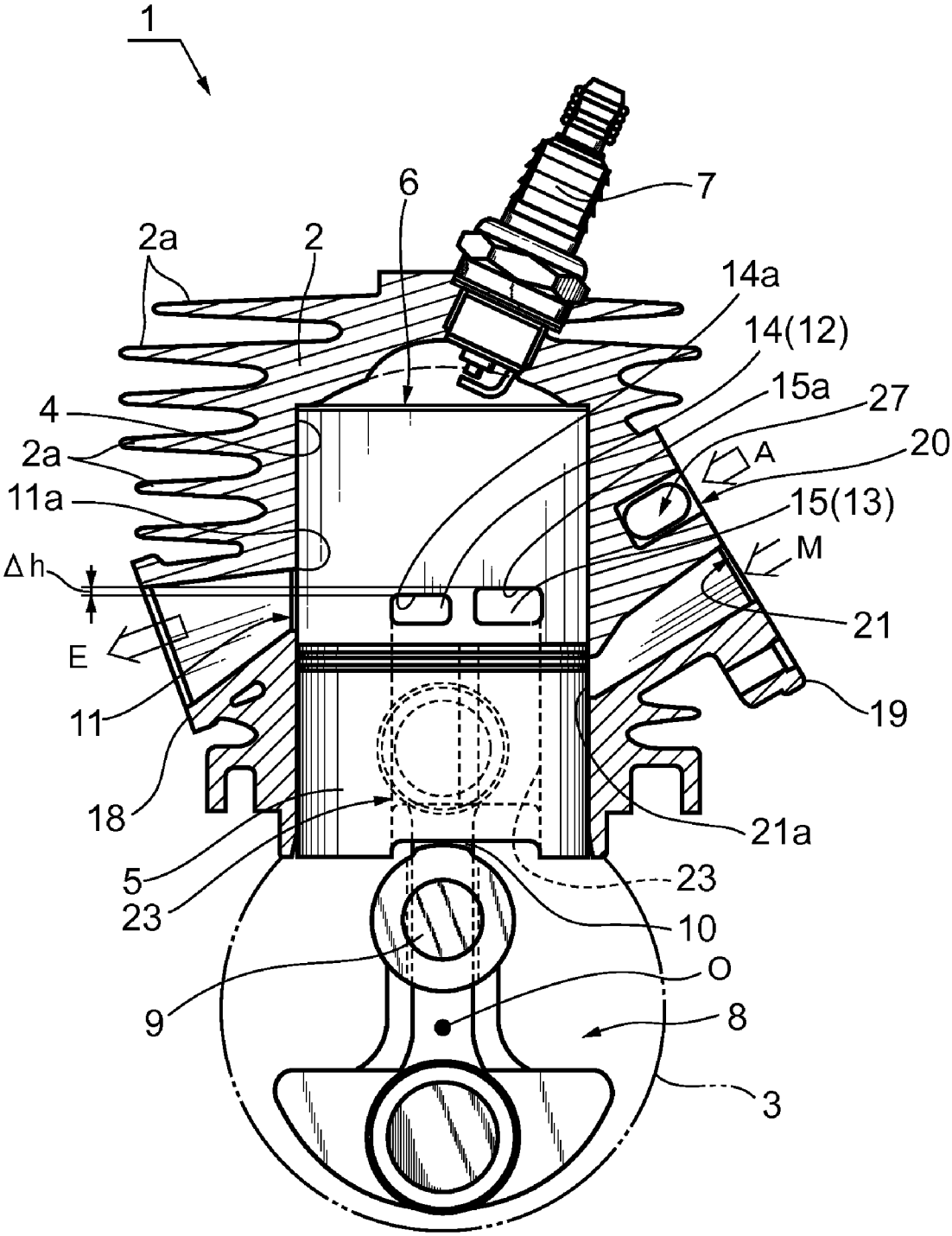
FIG. 1 is a longitudinal cross-sectional view of the two-stroke internal combustion engine taken as an embodiment of the present invention.

A two-stroke internal combustion engine according to an embodiment of the present invention and some changes thereof are explained below with reference to the accompanying drawings. FIG. 1 and other drawings illustrate an example to be brought into operation as a single-cylinder. The two-stroke internal combustion engine generally designated with reference numeral 1 is a four-flow scavenging, air-cooled, compact two-stroke gasoline engine used in portable power working machines.

As shown in FIG. 1, the engine 1 includes a cylinder block 2 having cooling fins 2*a*, and a crank case 3 connected to the bottom of the cylinder block 2. A cylinder bore 4 formed in the cylinder block 2 fittingly receives a piston 5 to permit its reciprocal movement therein. The piston 5 defines a combustion chamber 6 in the cylinder bore 4.

The combustion chamber 6 has a squish-dome (hemispherical) shape. An ignition plug 7 is disposed at the top of the combustion chamber 6. In a crank chamber 8 defined by the crank case 3, a crankshaft 9 is supported for pivotal movement by the crank case 3. In FIG. 1, the reference symbol O indicates the rotation center of the crankshaft 9. The crankshaft 9 and the piston 5 are connected to each other by a connecting rod 10. Reciprocal movement of the piston 5 is converted to rotational movement by the crankshaft 9, and the engine power is output in form of rotation of the crankshaft 9.

Figure 2:
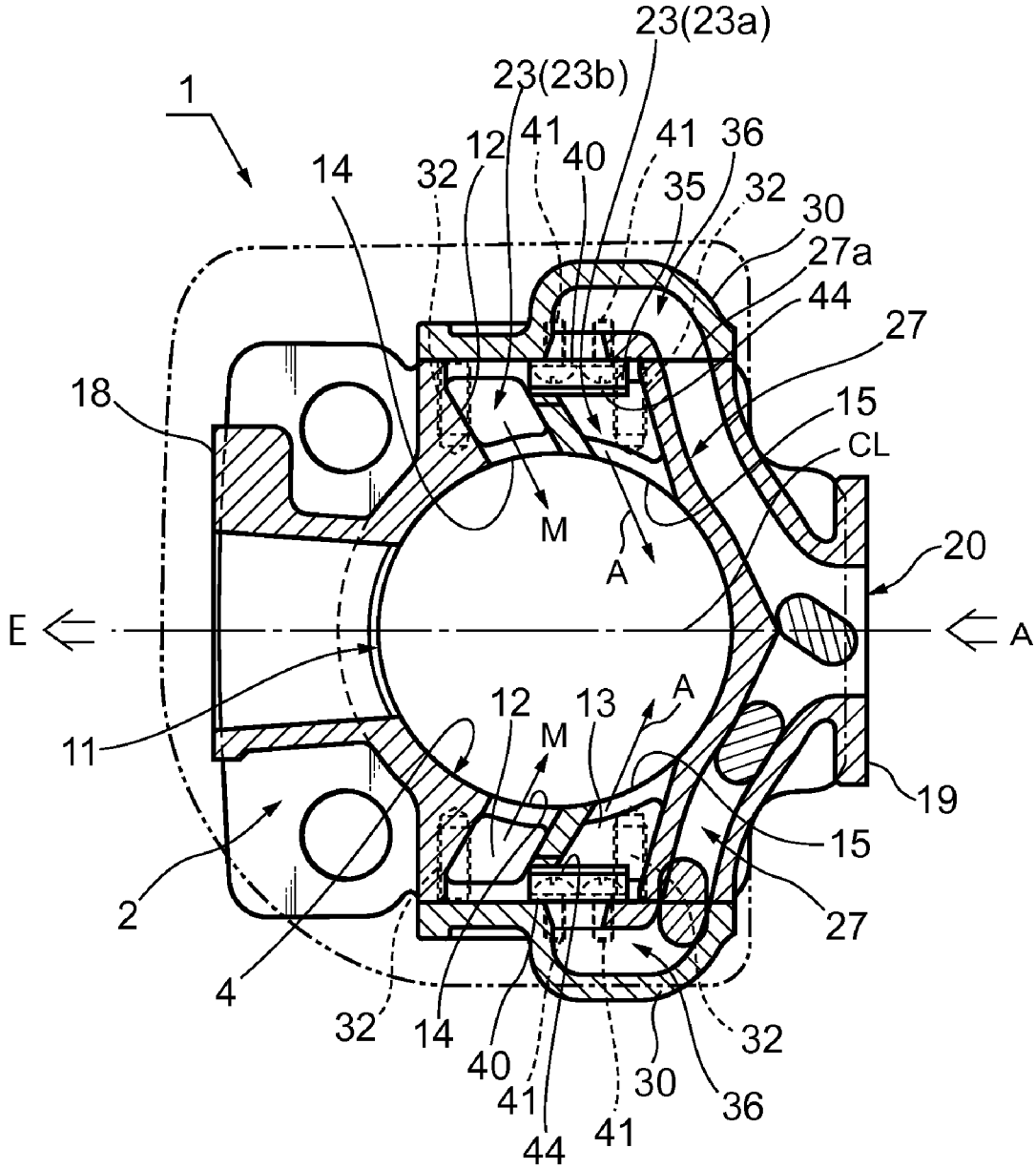
FIG. 2 is a cross-sectional view of the engine of FIG. 1.
Figure 5:
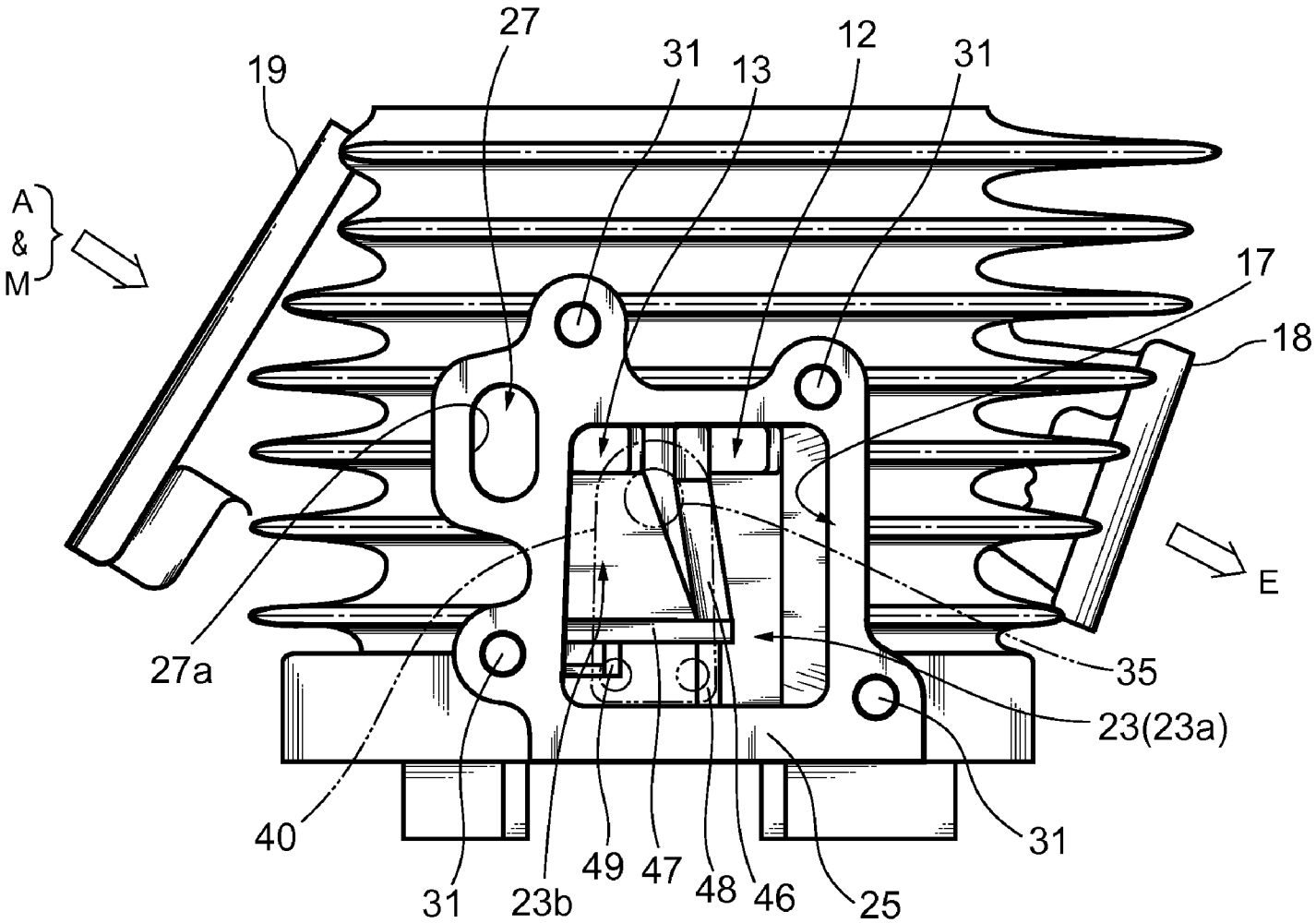
FIG. 5 is a side elevation of the cylinder block, explaining a rectangular opening (in-block passage), which opens at a side portion of the cylinder block.

As shown in FIG. 2 that is a longitudinal cross-sectional view, the cylinder block 2 has a single exhaust port 11 opening toward the cylinder bore 4 to discharge exhaust gas E. The cylinder block 2 further has a pair of first Schnurle-type scavenging ports 12 and a pair of second Schnurle-type scavenging ports 13 formed therein in bilateral symmetry, respectively, with respect to an imaginary center line CL (see FIG. 2) connecting the center of the exhaust port 11 and the center of the cylinder bore 4. Each of the first and second scavenging ports 12 and 13 is open to outside through a rectangular side opening 17 formed in the cylinder block 2 as shown in FIG. 5.

Referring again to FIG. 1, with regard to the pair of first scavenging ports 12 located relatively nearer to the exhaust port 11 and the pair of second scavenging ports 13 located remoter from the exhaust port, the first and second scavenging ports 12 and 13 have first and second rectangular scavenging windows 14 and 15, respectively, which are open to the cylinder bore 4. All the scavenging windows 14 and 15 are positioned at a level lower than an upper edge 11*a* of the exhaust port 11. Upper edges 14*a* and 15*a* of the first and second scavenging windows 14 and 15 are positioned at different levels from each other as best shown in FIG. 1. The upper edge 14*a* of the first scavenging window 14 is at a level lower than the upper edge 15*a* of the second scavenging window 15. In other words, the upper edge 15*a* of the second scavenging window 15 remoter from the exhaust port 11 is at a level higher by $\Delta h$ than the first scavenging window 14 nearer to the exhaust port 11 as shown in FIG. 1.

That is, as the piston 5 descends, this two-stroke engine 1 first opens the exhaust port 11, and in the next scavenging stroke, opens the first scavenging ports 12 after opening the second scavenging ports 13.

Figure 3:
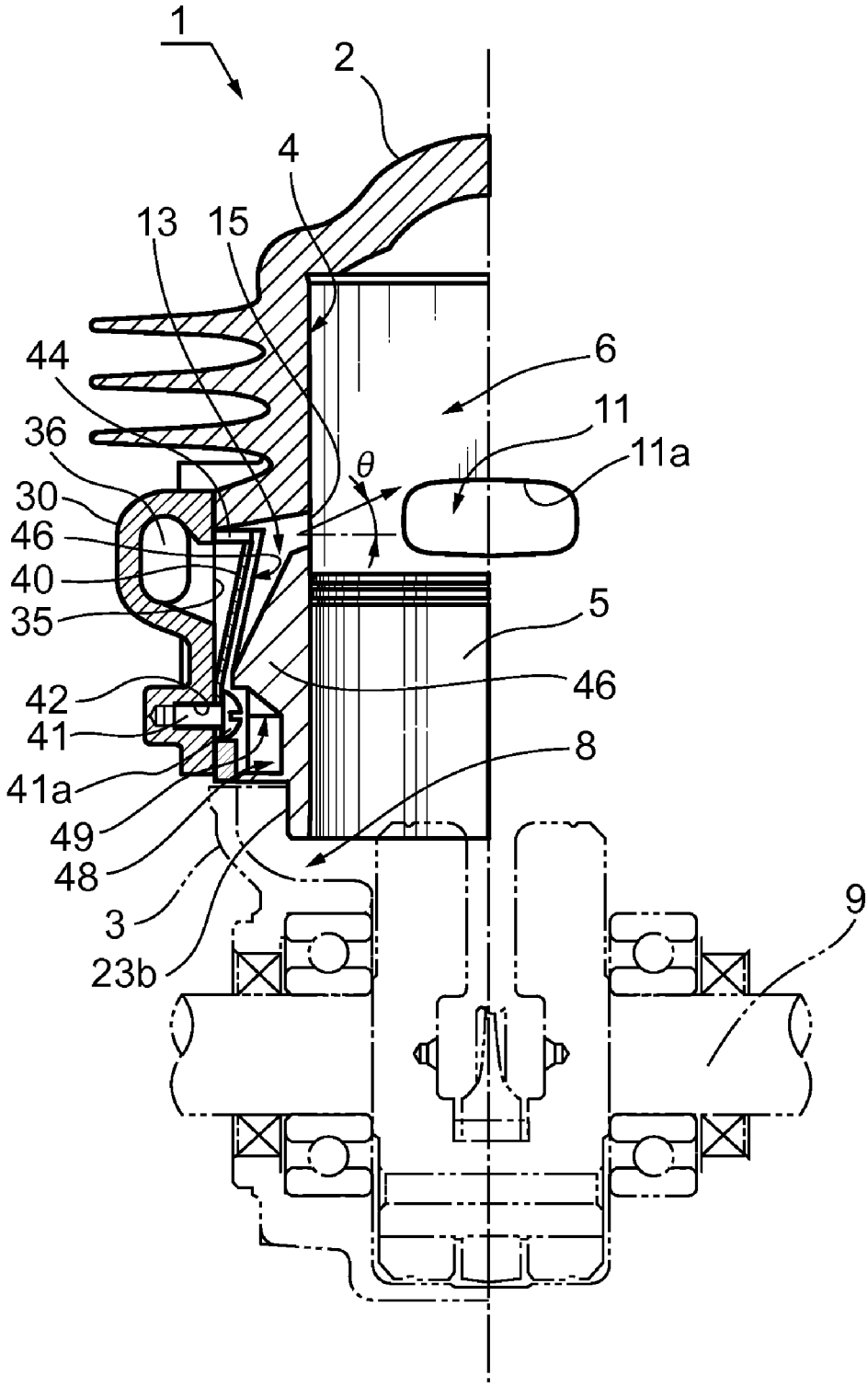
FIG. 3 is a fragmentary longitudinal cross-sectional view of the two-stroke internal combustion engine of FIG. 1, especially for showing a cross-sectional configuration of a second scavenging port.

The first and second scavenging ports 12 and 13 are slanted in a direction opposite from the exhaust port 11 when viewed in a horizontal plane as best shown in FIG. 2, and directed upward by an angle $\theta$ (angle of elevation) when viewed in a vertical plane as best shown in FIG. 3. Although FIG. 3 shows the second scavenging ports 13 alone, the first scavenging ports 12 is also directed upward by a similar angle of elevation.

The angles of elevation of the first and second scavenging ports 12 and 13 may be either equal to, or different from, each other. Preferably, the angle of elevation of the second scavenging port 13 should be designed larger than that of the first scavenging port 12.

Figure 4:
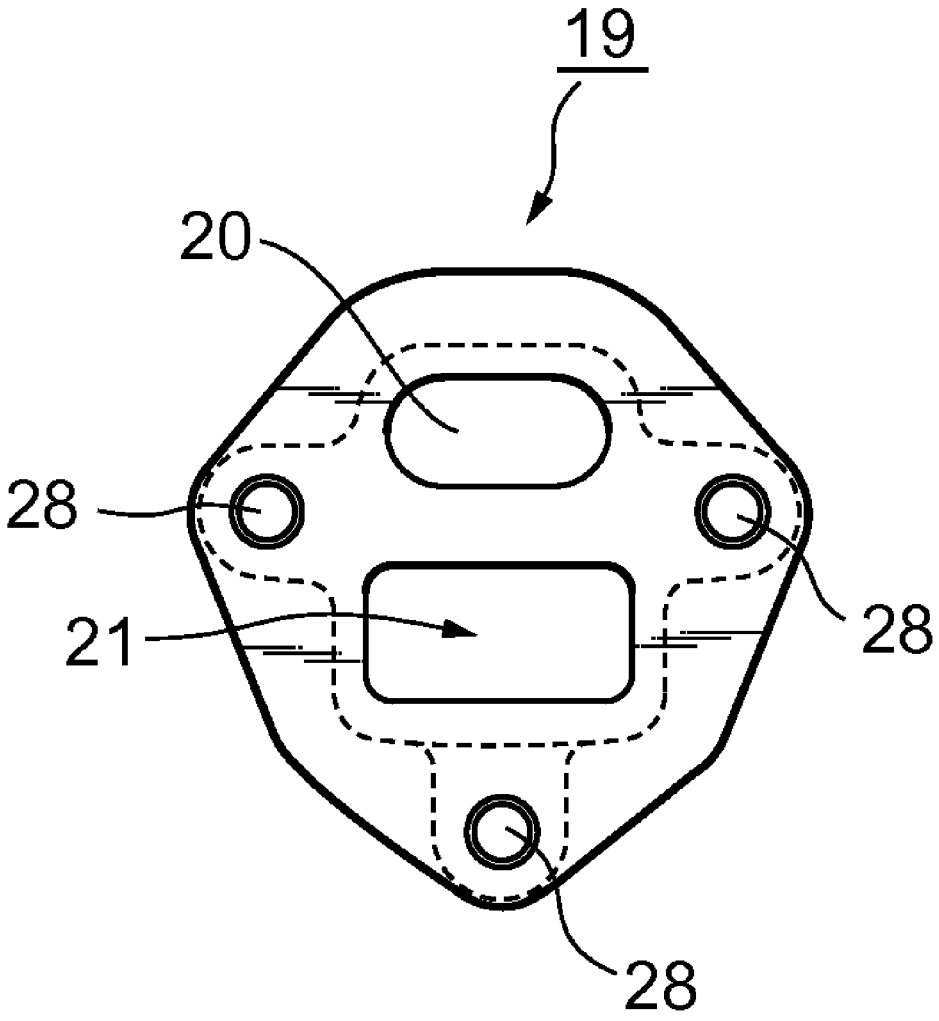
FIG. 4 is a front elevation of an intake-side flange of a cylinder block used in the engine of FIG. 1.

As shown in FIG. 1, the cylinder block 2 has an outlet-side flange 18 having the exhaust port 11, and an intake-side flange 19 located at a diametrically opposite position. The intake-side flange 19 has two passages 20 and 21 vertically separated from each other. FIG. 4 is a front elevation only of the intake-side flange 19 of the cylinder block 2. Referring to FIG. 1 and FIG. 4, the upper passage 20 has a cross section with its longer axis lying horizontally. The air A containing no fuel (which may be substantially pure air and herein called "fuel-free air" as well) flows through the passage 20. The lower passage 21 has a rectangular cross section (FIG. 4). The air-fuel mixture M flows through the lower passage 21.

Connected to the intake-side flange 19 are intake system components including an air cleaner and a carburetor with a throttle valve (both not shown in FIG. 1). Fuel-free air A is supplied from the carburetor to the upper air passage 20 as described in Document 3 (JP 2000-240457) as well, and an air-fuel mixture M is supplied to the lower air-fuel mixture passage 21.

The air-fuel mixture passage 21 communicates with the crank chamber 8 through an air-fuel mixture outlet 21*a* that is open to the lower end of the cylinder bore 4 as shown in FIG. 1. As the piston 5 ascends, the air-fuel mixture M is supplied to the crank chamber 8 through the air-fuel mixture outlet 21*a*.

Figure 6:
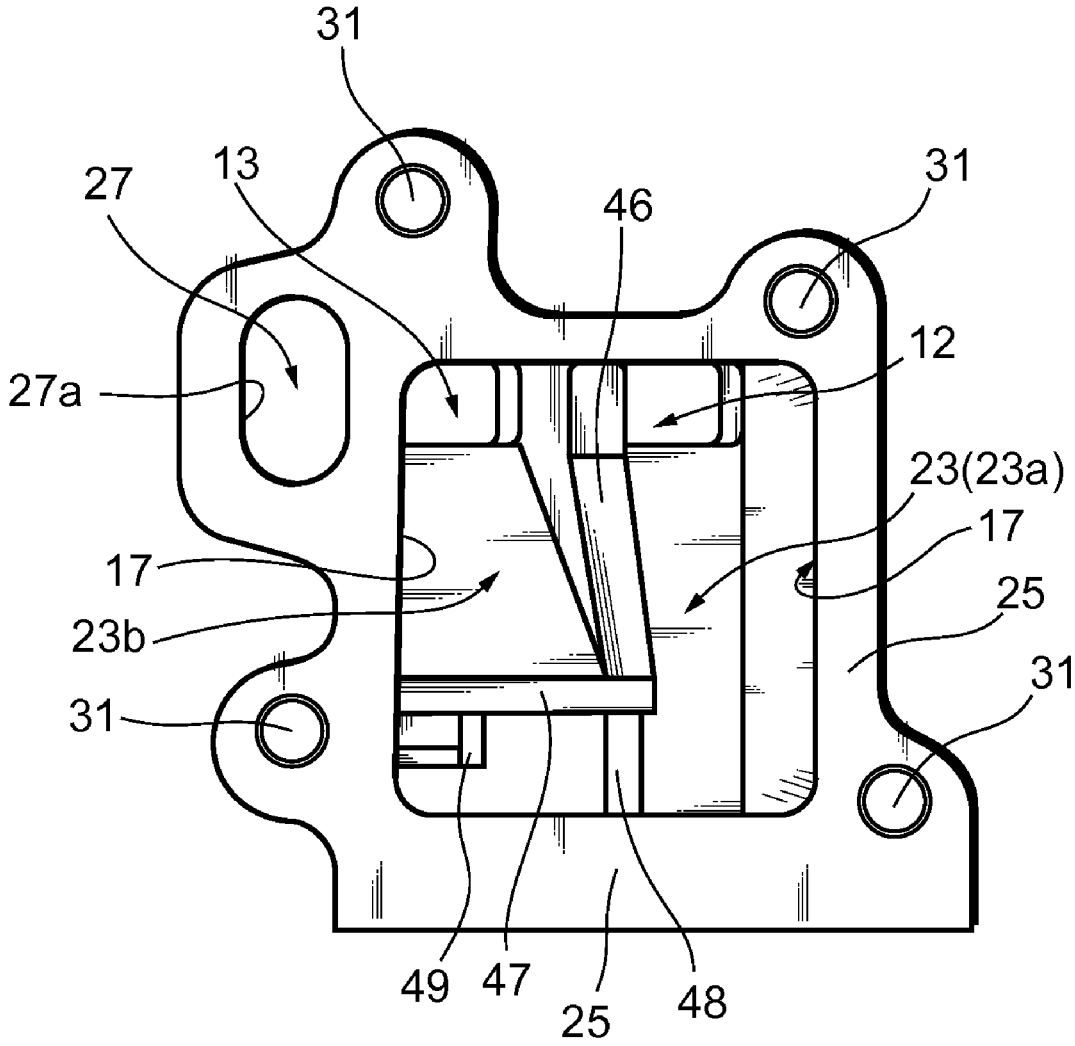
FIG. 6 is an enlarged front elevation of a side flange shown in FIG. 5 especially for explaining the internal structure of the rectangular opening and the side flange around the rectangular opening.

The cylinder block 2 has formed therein an in-block passage 23 vertically extending along the cylinder bore 4 as shown in FIGS. 1, 5 and 6. FIG. 6 is a front elevation of a side flange 25 including the rectangular side opening 17 formed on the lateral side of the cylinder block 2. The main function of the in-block passage 23 is to make communication of the first scavenging port 12 with the crank chamber 8 such that the air-fuel mixture M pre-compressed in the crank chamber 8 can be introduced into the combustion chamber 6.

With reference to FIGS. 2 and 4, the upper air passage 20 is branched into two air inlet portions 27 each terminating at an air outlet 27*a* open to the lateral side of the cylinder block 2. In FIG. 2, elliptic figures with hatchings are shown in the air passage 20. These figures show that the air passage 20 has an elliptic cross section and in which directions the longer axis of the air passage 20 becomes oriented from portion to portion thereof. That is, at the outlet portions 27*a*, the air passage 20 exhibits an elliptic cross section with its longer axis extending upright (vertically) when viewed in FIG. 2. Upstream thereof, however, the longer axis of the elliptic cross-section gradually inclines, and eventually lies approximately horizontal near the inlet. More specifically, the air inlet portion 27 of the air passage 20 is oriented to lay the longer axis of its elliptic cross section in a lateral direction at the branching point near the front end, and toward the downstream end, the longer axis gradually rises until it stands upright at the air outlet 27*a* that is a perimeter of the air passage 20. That is, the air inlet portion 27 has the elliptic cross section along its entire length, and it is twisted such that the elliptic cross section is horizontally long in the upstream portion, then twisted gradually toward downstream, and finally becomes vertically long at the passage end portion (the air outlet portion 27*a*). The air inlet portions 27 and air outlet portions 27*a* are adjacent to the cylinder bore 4 and second scavenging port 13 and extend curvedly along the latter when viewed in a plane as best shown in FIG. 2. In other words, the air passage 20 has a configuration closely fitting the cylinder bore 4 and the second scavenging port 13 while generally curving along their contours.

Figure 7:
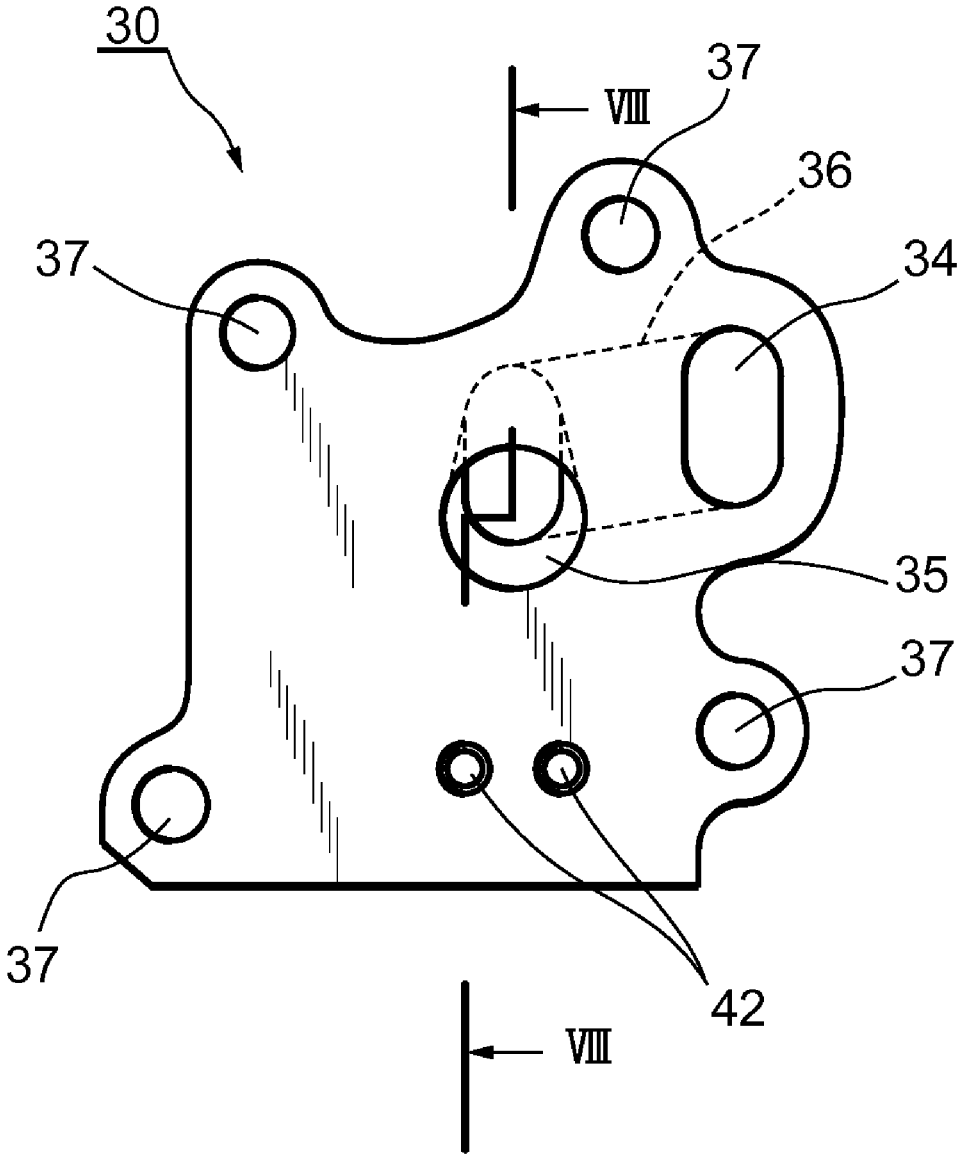
FIG. 7 is a front elevation of a passage-defining member fixed to the cylinder block to make an external air passage.
Figure 8:
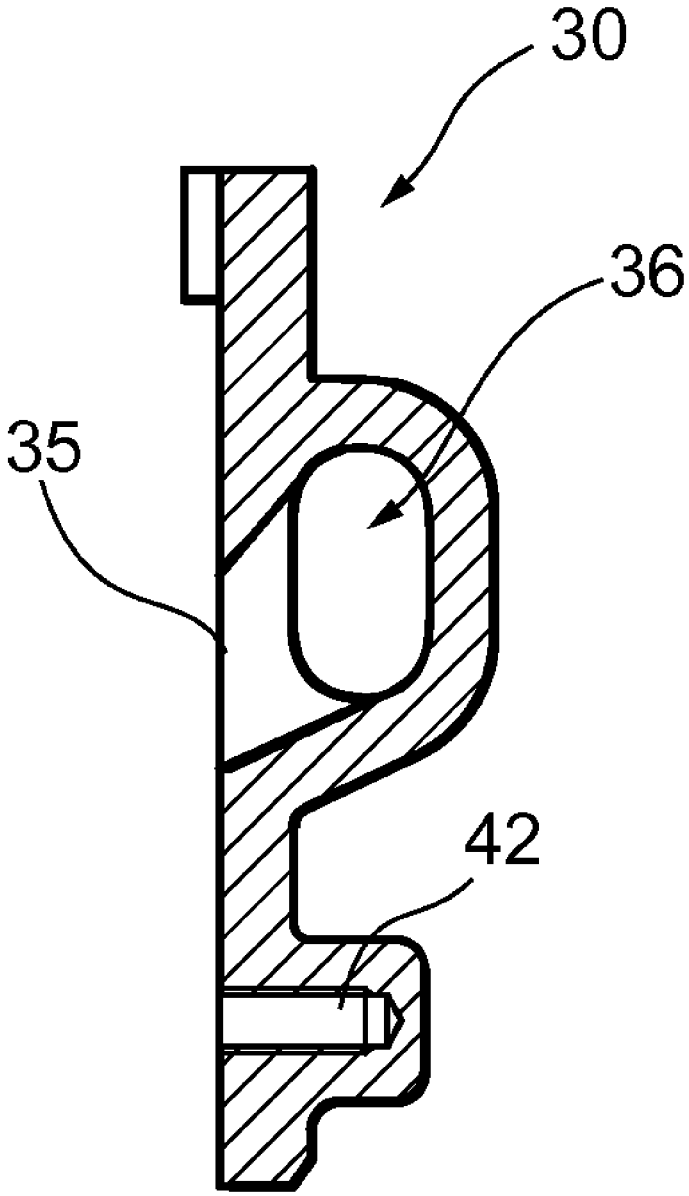
FIG. 8 is a cross-sectional view taken along the VIII-VIII line in FIG. 7.

FIGS. 5 and 6 illustrate the side flange 25 provided around the rectangular side opening 17. FIG. 6 is a front elevation of the side flange 25 alone. The side flange 25 has a passage-defining member 30 fixed thereto as shown in FIGS. 7 and 8. Reference numeral 31 denotes threaded holes formed in the side flange 25. The passage-defining-member 30 is fixed to the cylinder block 2 with bolts 32 (shown with an imaginary line in FIG. 2) inserted in individual bolt holes 37 formed in the passage-defining member 30 to make pairs with the threaded holes 31. Thereby, the rectangular side opening 17 in the cylinder block 2 is covered.

As shown in FIGS. 7 and 8, the passage-defining member 30 has an outer contour corresponding to the shape of the side flange 25 of the cylinder 2. The passage-defining member 30 also has formed therein an inlet opening 34 (FIG. 7) opposed to the air outlet 27*a* (see FIG. 6) that opens to the side flange 25; an outlet opening 35 (see FIG. 7) opposed to the second scavenging port 13 (FIG. 6); and an external air passage 36 connecting the inlet opening 34 and the outlet openings 35. As shown in FIGS. 6 and 7, the inlet opening 34 has a vertically long elliptic shape. As shown in FIG. 7, the external air passage 36 has a vertically long elliptic cross section as well. On the other hand, the outlet opening 35 is circular (see FIG. 8), and is substantially equal in effective sectional area to the inlet opening 34 and the external air passage 36. In FIG. 7, reference numeral 37 indicates bolt holes for insertion of the bolts 32.

Once the passage-defining member 30 is fixed to the cylinder block 2, the second scavenging ports 13 are connected to the air passage 20 (air inlet portion 27), which serves to introduce fuel-free air, via the external air passage 36 of the passage-defining member 30.

As already explained, the fuel-free air A enters into the cylinder block 2 through the air passage 20 having the laterally long elliptic cross section (see FIG. 4) there, and it is supplied to the second scavenging ports 13 from the external air passage 36, having the vertically long elliptic cross section there, of the passage-defining member 30 through the air inlet portions 27 each having the laterally long elliptic cross section. More specifically, the passage for supplying fuel-free air A changes its cross section from a laterally long one to a vertically long one (air inlet portion 27), and maintains the vertically long one in the portion from the air inlet portion 27 to the external air passage 36. Then, the outlet opening 35 of the external air passage 36 that opens to the scavenging port 13 changes to a circular shape. Note that the passageway for guiding the fuel-free air A to the second scavenging ports 13 is substantially constant in effective sectional area throughout its entire length.

As shown in FIGS. 2 and 3, the passage-defining member 30 has a reed valve 40 and reed valve guide 44 that are fixed thereto by one or more screws 41 (two screws in the illustrated embodiment). The screws 41 are inserted into threaded holes 42 (see FIG. 7) formed in the passage-defining member 30. When the passage-defining member 30 is fixed to the cylinder block 2 with the bolts 32, the screw heads 41*a* are received within the second scavenging ports 13.

The reed valve 40 is provided in the outlet opening 35 (herein called "downstream opening 35" as well) of the external air passage 36 in the passage-defining member 30 to open and close the outlet opening 35. More specifically, when the pressure in the in-block passage 23 becomes relatively lower, the reed valve 40 is opened and permits the fuel-free air A to flow into the first and second scavenging ports 12 and 13 through the air passage 20 and the external air passage 36. On the contrary, when the pressure in the first and second scavenging ports 12 and 13 becomes relatively higher, the reed valve 40 is closed and prevents that the gas flows out from the cylinder bore 4 and/or crank chamber 8 through the first and second scavenging ports 12 and 13.

As shown in FIGS. 3, 5 and 6, the in-block passage 23 is partitioned by a first partition wall (vertical) 46 extending vertically into a first inner passage 23*a* communicating with the first scavenging ports 12 and a second inner passage 23*b* partly communicating with the second scavenging ports 13. The second inner passage 23*b* is further partitioned by a second partition wall (horizontal) 47 to restrict the portion in communication with the second scavenging ports 13. That is, only a limited part of the in-block passage 23 is substantially allowed to communicate with the second scavenging ports 13 by the first and second partition walls 46 and 47. The limited portion of the second inner passage 23*b* in communication with the second scavenging ports 13 serves to store a predetermined amount of fuel-free air A supplied from the intake system for use in scavenging.

The in-block passage 23 has first and second vertical ribs 48, 49. The first rib 48 extends downward from a lower end of the first vertical partition wall 46, which corresponds to an end of the second partition wall 47 extending horizontally. The second rib 49 extends downward from a horizontal mid portion of the horizontal second partition wall 47. Positions of the first and second ribs 48 and 49 are in alignment with positions of the two screws 41 provided to fix the reed valve 40. Alternatively, the first partition wall 46 and/or the second partition wall 47 may be in alignment with the positions of the screws 41. These first and second ribs 48, 49 are in locations opposed to the two screws 41 or their screw heads 41*a* respectively. Therefore, the ribs 48, 49 prevent the two screws 41 from dropping inside the crank chamber 8, for example, and thereby causing malfunctions of the engine.

Figure 9:
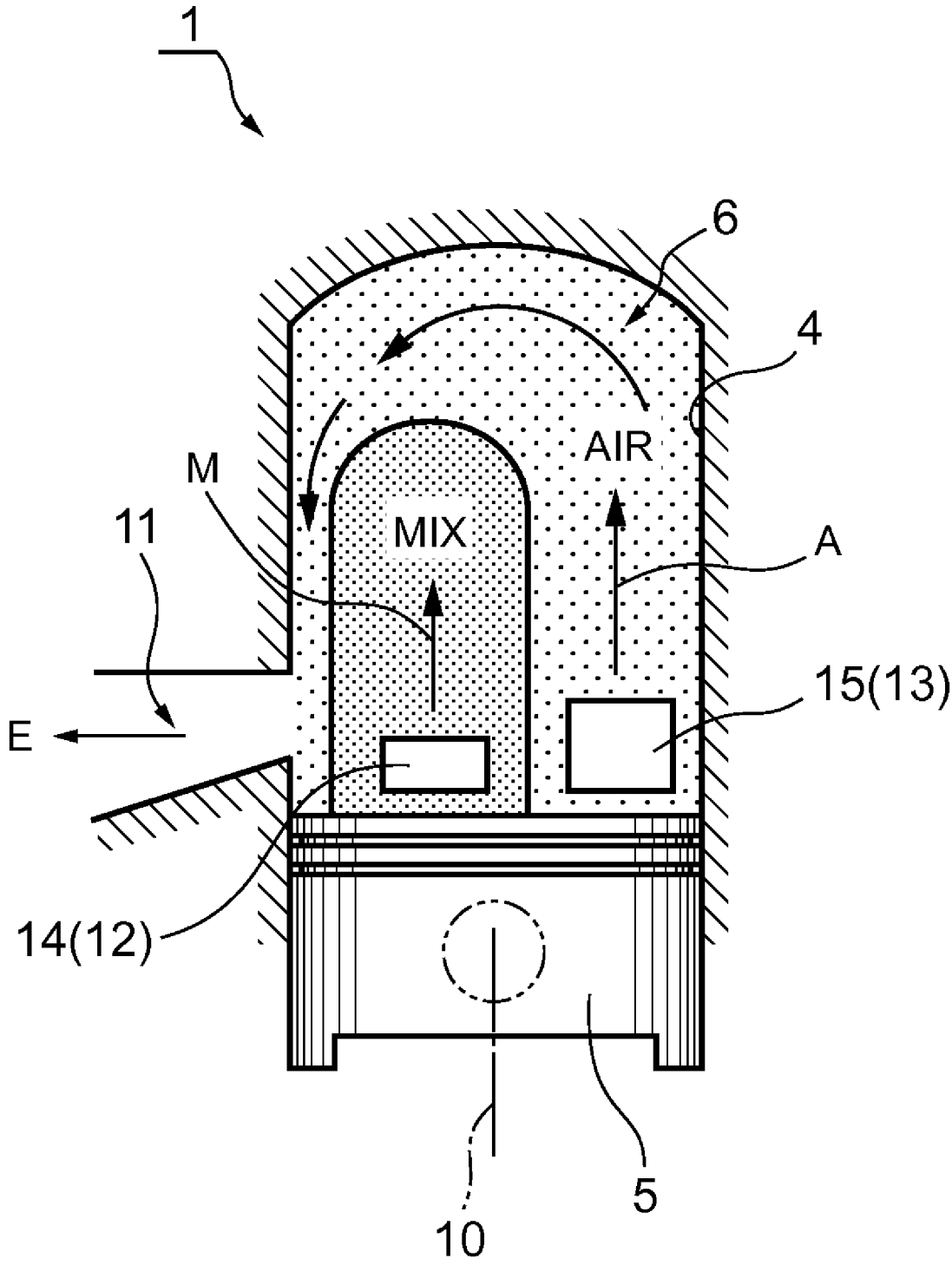
FIG. 9 is a diagram for explaining operations in a scavenging stroke of the two-stroke engine according to embodiments of the present invention.

In a scavenging stroke of the above-explained two-stroke internal combustion engine 1, the fuel-free air A is first introduced to the combustion chamber 6 from one of the first and second scavenging ports 12, 13, namely, the second scavenging ports 13, which is remoter from the exhaust port 11. At this time, the fuel-free air A existing in the first scavenging ports 12 is also drawn into the combustion chamber 6. Then, the air-fuel mixture M is introduced into the combustion chamber 6 from the first scavenging ports 12 nearer to the exhaust pot 11. Therefore, the fuel-free air A introduced from the second scavenging ports 13 results in enveloping the air-fuel mixture M introduced later into the combustion chamber 6 from the first scavenging ports 12 as shown in FIG. 9. This is effective to prevent that the air-fuel mixture M introduced into the combustion chamber 6 and having not burnt is discharged to outside through the exhaust port 11. That is, the so-called "blow-by" phenomenon is prevented.

Figure 10:
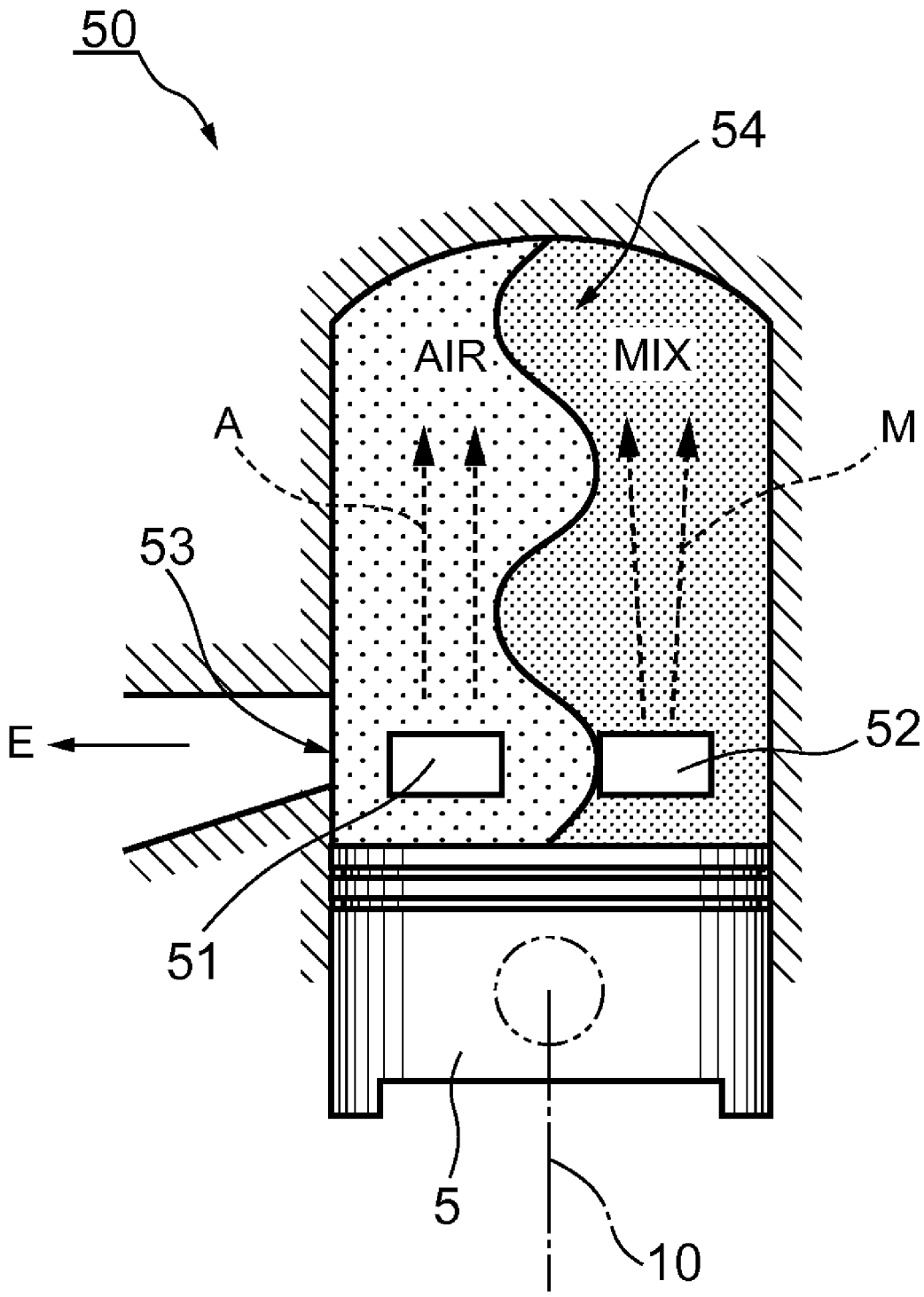
FIG. 10 is a diagram for explaining operations in a scavenging stroke of a conventional two-stroke engine taken as a comparative example.

FIG. 10 shows a conventional stratified-scavenging two-stroke internal combustion engine 50 as a comparative example. The conventional engine 50 is so designed that fuel-free air A is introduced into a combustion chamber from one of first scavenging ports 51 and second scavenging ports 52, namely from the first scavenging ports 52 that are nearer to an exhaust port 53, and an air-fuel mixture M is introduced from the second scavenging ports 52 located remoter from the exhaust port 53. In this conventional scavenging system, the air-fuel mixture M and fuel-free air A are not separated distinctly from each other in the combustion chamber 54. Therefore, the mixture M is much more likely to flow out through the exhaust port 53.

Figure 11:
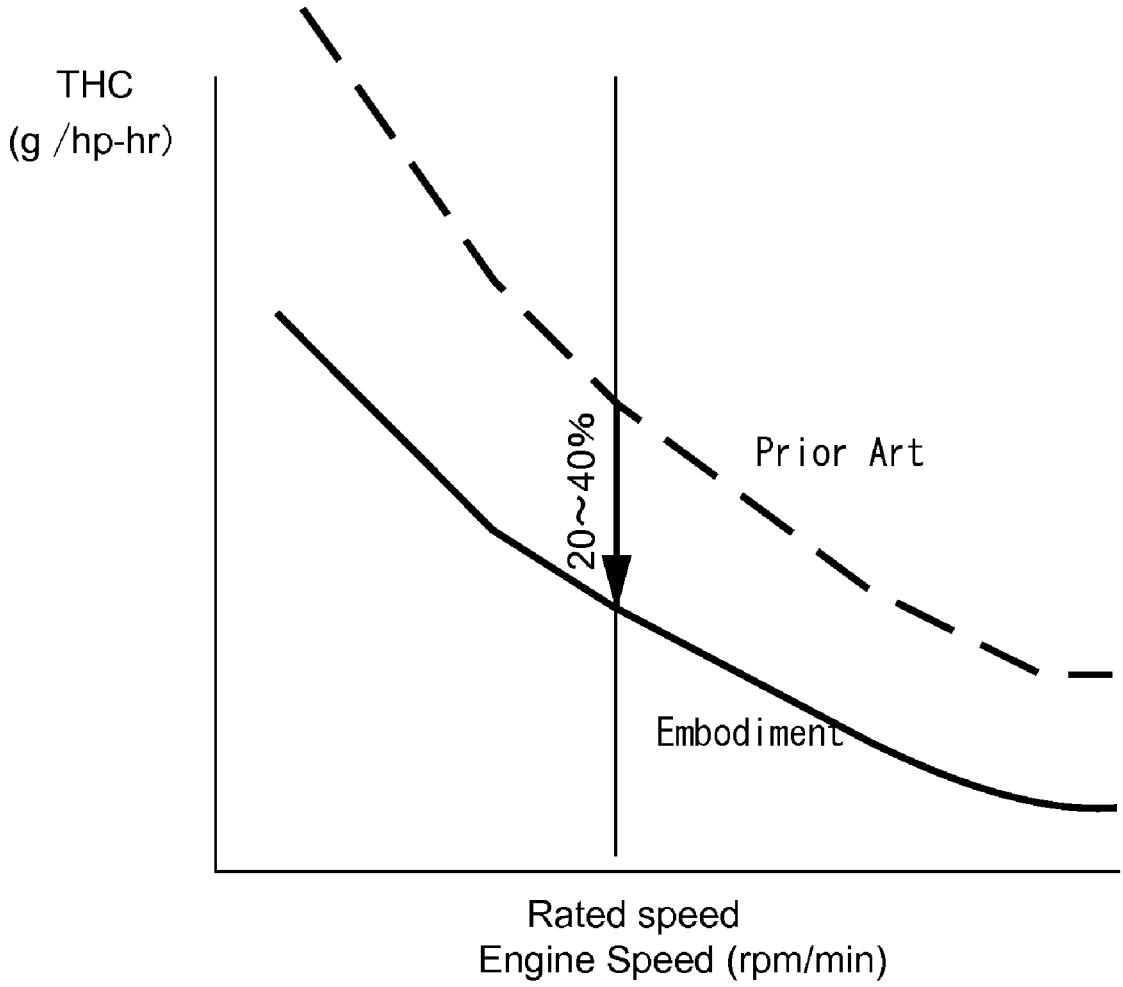
FIG. 11 is a diagram for explaining effects of purifying exhaust gas by the two-stroke engine according to embodiments of the present invention.

To confirm the exhaust gas purification effect of the two-stroke internal combustion engine according to the present invention, an engine 1 according to the present invention and a conventional engine 50 (see FIG. 10) were produced which are equal to each other in basic design factors such as engine displacement, cylinder bore size, etc. These engines 1 and 50 were compared in amount of unburnt gas components contained in exhaust gases from them. The result of comparison is shown in FIG. 11. This shows approximately 20% to 40% cutdown of unburnt gas components by the engine 1 according to the present invention.

As explained above, in the two-stroke internal combustion engine 1 taken as an embodiment of the present invention, the fuel-free air A first introduced into the combustion chamber 6 through the second scavenging ports 13 located farther from the exhaust port 11 makes loops in the combustion chamber 6, and envelopes with these loops the air-fuel mixture M introduced later into the combustion chamber 6. Therefore, it is possible to suppress the "blow-by" of the air-fuel mixture M better than the conventional engine 50 and to reduce harmful components in the exhaust gas E.

Furthermore, in the two-stroke internal combustion engine 1 as an embodiment of the present invention, the passage-defining member 30 is fixed to the cylinder block 2 to supply the second scavenging ports 13 with air A. In addition to this, the air inlet portions 27 (see FIG. 2) for guiding the fuel-free air A to the second scavenging ports 13 have an elliptic cross section longer in an up and down direction, and have a configuration generally curved to fit contours of the cylinder bore 4 and the second scavenging port 13 in a tightly, closely fitting relation with them. Furthermore, the air inlet portions 27 are formed inside the cylinder block 2 to be adjacent to the cylinder bore 4 and the second scavenging ports 13. Therefore, the cylinder block 2 can be designed more compact than conventional engines in which air inlet portions are circular in cross section and extend straight.

Moreover, the two screws 41 fixing the reed valve 40 and the reed valve guide 44 in each second scavenging port 13 are restrained from loosening to droppage by the ribs 48 and 49 that are adjacent to the screw heads 41*a* inside the engine. Hence, it is possible to prevent that the screws 41 drop into the crank chamber 8 due to engine vibrations and to prevent damages that might be otherwise caused by such screws when they drop down into the crank chamber 8.

What is claimed is:

1. A two-stroke internal combustion engine configured to introduce fuel-free air into a combustion chamber together with an air-fuel mixture pre-compressed in a crank chamber in a scavenging stroke, comprising:

a cylinder bore in which a piston is fitted to reciprocally move and define the combustion chamber therein;

an exhaust port formed in the cylinder bore to be opened and closed by the piston;

first scavenging ports formed in the cylinder bore to be opened and closed by the piston; and second scavenging ports formed in the cylinder bore to be opened and closed by the piston, the second scavenging ports being remoter from the exhaust port than the first scavenging ports, the first and second scavenging ports being oriented in a direction of an elevation angle, and the angle of elevation of each second scavenging port being larger than the angle of elevation of each first scavenging port, wherein, in the scavenging stroke, the second scavenging ports are opened earlier than the first scavenging ports to introduce fuel-free air therefrom into the combustion chamber, and the first scavenging ports are opened later to next introduce an air-fuel mixture pre-compressed in the crank chamber into the combustion chamber.

2. The two-stroke internal combustion engine according to claim 1 wherein the first scavenging ports comprise a pair of scavenging ports located at opposite sides of the exhaust port, and the second scavenging ports comprise a pair of scavenging ports located at opposite sides of the exhaust port.

3. The two-stroke internal combustion engine according to claim 2 wherein the first and second scavenging ports are directed away from the exhaust port in a horizontal direction, respectively.

4. A two-stroke internal combustion engine configured to introduce fuel-free air into a combustion chamber together with an air-fuel mixture pre-compressed in a crank chamber in a scavenging stroke, comprising:

a cylinder bore in which a piston is fined to reciprocally move and define the combustion chamber therein;

an exhaust port formed in the cylinder bore to be opened and closed by the piston;

a pair of first scavenging ports formed at opposite sides of the exhaust port in the cylinder bore to be opened and closed by the piston; and a pair of second scavenging ports formed at opposite sides of the exhaust port in the cylinder bore to be opened and closed by the piston, the second scavenging ports being remoter from the exhaust port than the first scavenging ports;

a passage-forming member associated with each of the second scavenging ports and fixed to a cylinder block, the passage-forming member having an external air passage for supplying the associated second scavenging port with the fuel-free air;

a reed valve and a reed valve guide both associated with each of the second scavenging ports and fixed by at least one screw at a downstream opening of the external air passage; and a rib formed on the cylinder block in association with the downstream opening of the external air passage to confront a screw head of the screw, wherein, in the scavenging stroke, the second scavenging ports are opened earlier than the first scavenging ports to introduce fuel-free air therefrom into the combustion chamber, and the first scavenging ports are opened later to next introduce an air-fuel mixture pre-compressed in the crank chamber into the combustion chamber.

5. The two-stroke internal combustion engine according to claim 4 wherein the rib comprises a partition wall that partitions each of the second scavenging ports from adjacent one of the first scavenging ports.

6. The two-stroke internal combustion engine according to claim 4 wherein the rib extends from a partition wall that partitions each of the second scavenging ports from adjacent one of the first scavenging ports.

7. The two-stroke internal combustion engine according to claim 4 further comprising:

an air passage formed in the cylinder block to supply the fuel-free air to the external air passages of passage-forming members, wherein the air passage has a configuration closely fining the cylinder bore and the second scavenging ports while partly curving along their contours, and the air passage has at curved portions thereof an elliptic cross section with its longer axis extending in a vertical direction.

* * * * *

UNITED STATES PATENT AND TRADEMARK OFFICE

CERTIFICATE OF CORRECTION

PATENT NO. : 7,520,253 B2
APPLICATION NO. : 11/924665
DATED : April 21, 2009
INVENTOR(S) : Mochizuka et al.

It is certified that error appears in the above-identified patent and that said Letters Patent is hereby corrected as shown below:

Claim 4, column 8, line 64, “fined” should read --fitted--.

Claim 7, column 10, line 17, “fining” should read --fitting--.

Signed and Sealed this

Nineteenth Day of May, 2009

JOHN DOLL
*Acting Director of the United States Patent and Trademark Office*